US010226930B2

(12) United States Patent
Otokita et al.

(10) Patent No.: US 10,226,930 B2
(45) Date of Patent: Mar. 12, 2019

(54) LIQUID EJECTING APPARATUS

(71) Applicant: SEIKO EPSON CORPORATION, Tokyo (JP)

(72) Inventors: Kenji Otokita, Yamagata-mura (JP); Seiji Ihara, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/881,273

(22) Filed: Jan. 26, 2018

(65) Prior Publication Data

US 2018/0222205 A1 Aug. 9, 2018

(30) Foreign Application Priority Data

Feb. 6, 2017 (JP) ..... 2017-019297

(51) Int. Cl.
*B41J 2/01* (2006.01)
*B41J 11/00* (2006.01)
*B41J 2/165* (2006.01)

(52) U.S. Cl.
CPC ..... *B41J 2/16579* (2013.01); *B41J 2/01* (2013.01); *B41J 11/0095* (2013.01)

(58) Field of Classification Search
CPC ..... B41J 2/16579; B41J 2/01; B41J 11/0095
See application file for complete search history.

(56) References Cited

U.S. PATENT DOCUMENTS

2017/0341373 A1* 11/2017 Kato ..... B41J 2/04505

FOREIGN PATENT DOCUMENTS

JP 2013-035184 A 2/2013

* cited by examiner

*Primary Examiner* — Bradley W Thies
(74) *Attorney, Agent, or Firm* — Workman Nydegger

(57) ABSTRACT

A detection unit that detects the presence of an object that can come into contact with a liquid ejecting unit with relative movement between a medium and the liquid ejecting unit is provided with a piezoelectric film sensor that outputs an electrical signal when the object comes into contact with the detection unit, where the detection unit has first, second, and third plate portions formed so as to be continuous, the first plate portion is fixed so that the second and third plate portions are cantilevered, and the second plate portion, in a state where the piezoelectric film sensor is mounted thereon, is continuous with the first plate portion and is disposed diagonally with respect to the vertical direction of the medium, and the third plate portion is bent from the second plate portion and faces the medium leaving a gap between the third plate portion and the medium.

5 Claims, 9 Drawing Sheets

LIQUID EJECTING APPARATUS

BACKGROUND

1. Technical Field

The present invention relates to a liquid ejecting apparatus.

2. Related Art

To date, a liquid ejecting apparatus that ejects a liquid such as ink onto a medium that is transported has been used. In such a liquid ejecting apparatus, the medium may rise up during the transportation process or a foreign object may adhere to the surface of the medium. In the case where the risen medium itself or a foreign object on the surface of the medium comes into contact with a liquid ejecting unit, at least one of the medium and the liquid ejecting unit may become damaged. Accordingly, various techniques have been disclosed for reducing the likelihood of a medium, a foreign object, or the like coming into contact with a liquid ejecting unit.

For example, JP-A-2013-35184 discloses a liquid ejecting apparatus (ink jet recording apparatus) that detects rising of a medium by an optical detection device in order to reduce the likelihood of a medium and a liquid ejecting unit coming into contact with each other. The presence or absence of a foreign object on the surface of the medium can also be detected by the optical detection device proposed in JP-A-2013-35184.

However, while the optical detection device disclosed in JP-A-2013-35184 can detect a foreign object with high accuracy, it is necessary to perform high-precision equipment adjustment such as optical axis adjustment between a light projecting portion on one end side of the medium and a light receiving portion on the other end side of the medium. In addition, various electrical control devices are required for oscillation control of laser light.

SUMMARY

An advantage of some aspects of the invention is that a foreign object detection device which can achieve high accuracy of foreign object detection as much as an optical detection device and which can simplify the adjustment of equipment is provided.

The invention is one that solves at least one part of the above mentioned problem and is capable of being realized as the following aspects.

(1) There is provided a liquid ejecting apparatus according to an aspect of the invention. The liquid ejecting apparatus according to an aspect of the invention includes a liquid ejecting unit that is arranged so as to face a medium and that ejects a liquid to the medium, a detection unit that detects the presence of an object that can come into contact with the liquid ejecting unit with relative movement between the medium and the liquid ejecting unit, and a piezoelectric film sensor that is provided in the detection unit that outputs an electric signal when the object comes into contact with the detection unit. Moreover, the detection unit has first, second and third plate portions formed so as to be continuous, the first plate portion is fixed in such a manner that the second and third plate portions are cantilevered, the second plate portion, in a state where the piezoelectric film sensor has been mounted thereon, is continuous with the first plate portion and is disposed diagonally with respect to a vertical direction of the medium, and the third plate portion is bent from the second plate portion and faces the medium leaving a gap between the third plate portion and the medium.

The liquid ejecting apparatus according to this aspect detects a foreign object adhering to the medium surface or a curved medium as follows. If a foreign object is attached to the surface of the medium or the medium itself is curved, the second plate portion or the third plate portion comes into contact with the foreign object or the curved medium, and the second plate portion consequently becomes distorted. The distortion of the second plate portion is detected with high sensitivity by the piezoelectric film sensor capable of detecting extremely small strain. As a result, in the liquid ejecting apparatus according to this aspect, foreign object detection can be performed with high accuracy. In addition, because the detection unit is located on the upstream side of the liquid ejecting unit in the medium transport direction, at the time of detecting a foreign object on the medium surface or a curved medium by the piezoelectric film sensor mounted on the second plate portion, the foreign object has not yet reached the liquid ejecting unit. Therefore, in the liquid ejecting apparatus according to this aspect, it is possible to enhance the effect of suppressing damage to the medium or the liquid ejecting unit caused by contact between a foreign object or a curved medium and the liquid ejecting unit.

(2) In the liquid ejecting apparatus according to the above-described aspect, the first plate portion may be fixed to a housing unit that houses the liquid ejecting unit. In this way, when detecting a foreign object attached to the surface of the medium or a curved medium, it suffices to fix the detection unit, to which the piezoelectric film sensor has been attached, to the housing portion via the first plate portion, and no special device adjustment or electrical control device is required. As a result, in the liquid ejecting apparatus according to this aspect, it is possible to simplify mechanical device adjustment while improving the precision of detection of a foreign object.

(3) In the liquid ejecting apparatus according to the above-described aspect, the first plate portion may be fixed at a position separated from the liquid ejecting unit, and the second plate portion may continue from the first plate portion toward a liquid ejecting unit side. In this case, because the third plate portion bent from the second plate portion is positioned on the liquid ejecting unit side, the size of the device along the medium transport direction can be reduced.

(4) In the liquid ejecting apparatus according to the above-described aspect, the second plate portion may continue from the first plate portion so that a formed angle between the second plate portion and the medium is 30° or less. By doing this, there are the following advantages. Because the third plate portion is formed in a cantilevered structure of a free end, the third plate portion vibrates about the fixing portion of the first plate portion. Such vibration is affected by the formed angle between the first plate portion, which is fixed, and the second plate portion, which is continuous therewith. In the liquid ejecting apparatus according to this aspect, because the formed angle between the second plate portion and the medium is smaller than 30°, the formed angle between the second plate portion and the vertical line at the fixing portion of the first plate portion is a bending angle in the range of more than 90° to 120°. With such a bending angle, it was experimentally found that the vibration of the second plate portion is suppressed by reducing the influence of the moment of inertia acting on the second plate portion. Therefore, in the liquid ejecting apparatus according to this aspect, it is possible to further improve the detection accuracy of detecting a foreign object by suppressing vibration of the second plate portion.

(5) In the liquid ejecting apparatus of the above-described aspect, the detection unit may further include a fourth plate portion bent from the third plate portion toward a side away from the medium. In this case, when the second plate portion is continuous toward the liquid ejecting unit side, even if the medium is transported in the opposite direction relative to the liquid ejecting unit, because the medium being reversely transported is pushed down by the fourth plate portion, a so-called transport jam of the medium being reversely transported can be suppressed by the fourth plate portion. Alternatively, in the case where the second plate portion is continuous from the liquid ejecting unit toward the upstream side in the transport direction, a foreign object can be guided to the third plate portion.

In addition, the invention can be realized in various aspects, for example, it can be realized in the form of an image forming apparatus, a printing apparatus, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
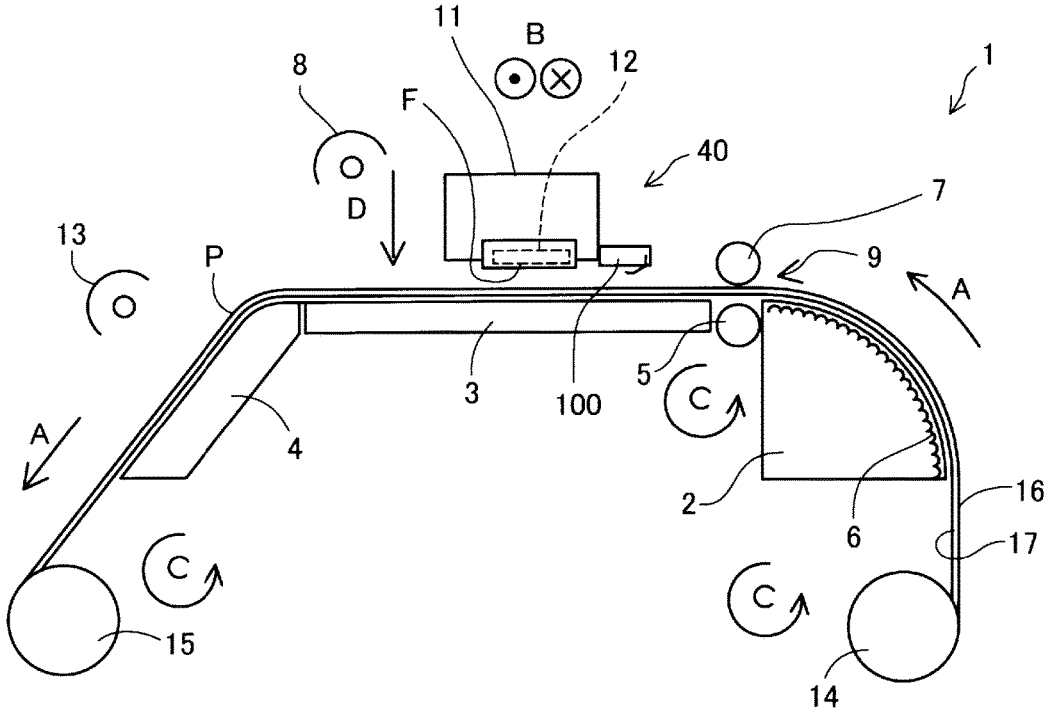
FIG. 1 is a schematic side view illustrating a schematic configuration of a recording apparatus having a liquid ejecting apparatus according to an embodiment of the invention.
Figure 2:
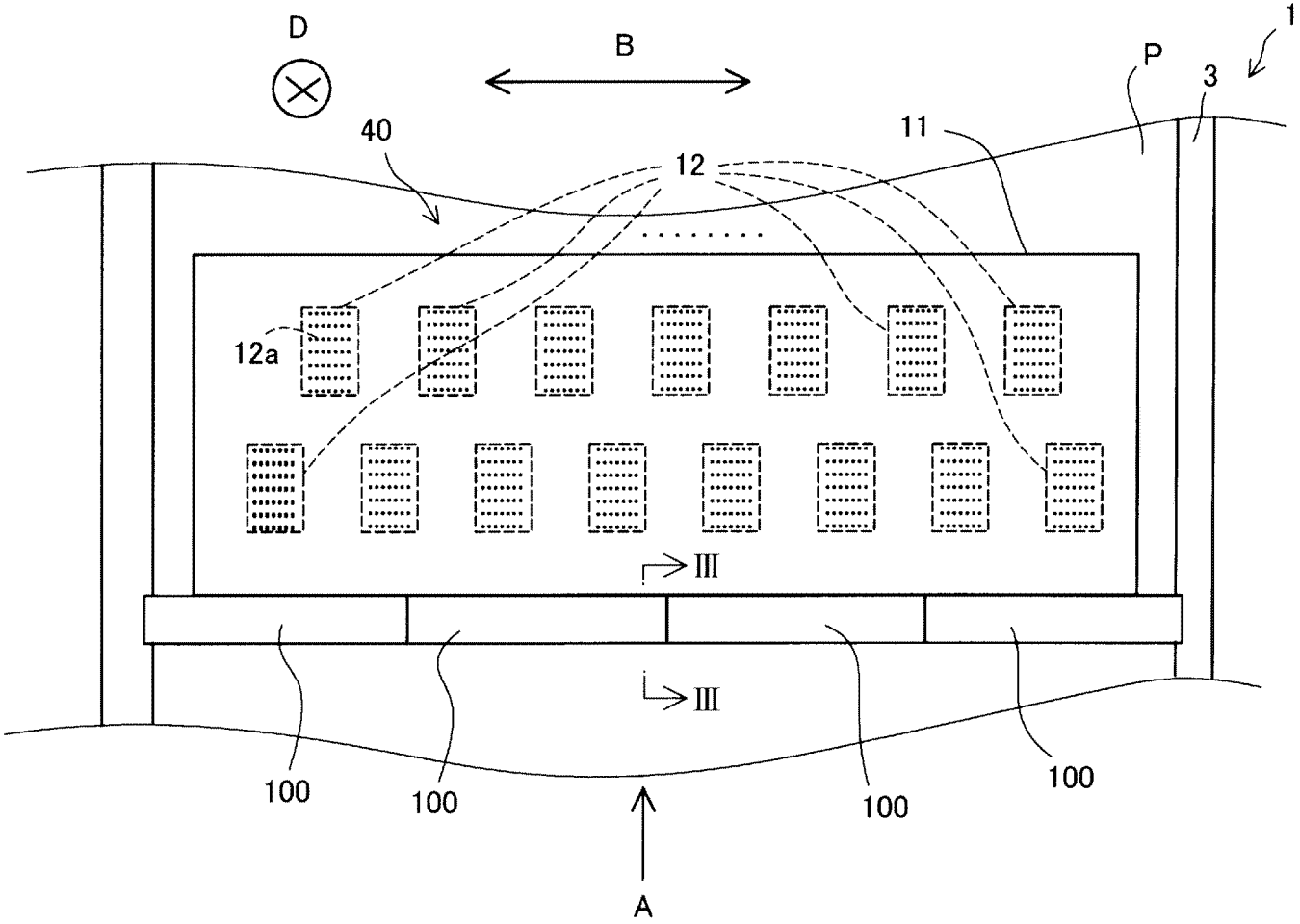
FIG. 2 is a schematic plan view schematically illustrating a peripheral configuration of a carriage included in the liquid ejecting apparatus in plan view.

FIG. 1 is a schematic side view illustrating a schematic configuration of a recording apparatus 1 having a liquid ejecting apparatus 40 according to an embodiment of the invention. FIG. 2 is a schematic plan view schematically illustrating a peripheral configuration of a carriage 11 included in the liquid ejecting apparatus 40 in plan view.

In the recording apparatus 1, a medium P is transported from a setting unit 14 for the medium P to a winding unit 15 for the medium P via a platen 2, a platen 3, and a platen 4 serving as support portions for the medium P, in a transport direction A (a direction from the setting unit 14 toward the winding unit 15). That is, the path from the setting unit 14 to the winding unit 15 is the transport path for the medium P in the recording apparatus 1, and the platen 2, the platen 3 and the platen 4 are support portions that are provided on the transport path and that support the medium P. The setting unit 14 sends out the medium P by rotating in a rotation direction C and the winding unit 15 winds up the medium P by rotating in the rotation direction C.

The recording apparatus 1 may have a configuration in which recording can be performed on the medium P in roll form; however, it is not limited to such a configuration and may have a configuration in which recording can be performed on the medium P in single sheet form. In the case of a configuration in which recording can be performed on the medium P in single sheet form, as the setting unit 14 for the medium P, for example, a so-called paper (feed) tray, paper (feed) cassette, or the like may be used. In addition, as a collecting unit for the medium P other than the winding unit 15, for example, a so-called discharge receiving unit, paper ejection (discharge) tray, a paper ejection (discharge) cassette, or the like may be used.

In this embodiment, because the medium P, which is wound up in a roll in such a manner that a recording surface 16 is on the outer side, is used, when sending out the medium P from the setting unit 14, the rotation shaft of the setting unit 14 rotates in the rotation direction C. However, in the case where the medium P, which is wound up in a roll in such a manner that the recording surface 16 is on the inner side, is used, by setting the setting unit 14 to a position that is horizontally mirror-inverted to the position illustrated in FIG. 1, it is possible to send out the target recording medium P by rotating the rotation shaft of the setting unit 14 in a direction opposite to the rotation direction C. Thus, similarly, because the winding unit 15 of this embodiment winds the medium P in such a manner that the recording surface 16 is on the outer side, the rotation shaft of the winding unit 15 rotates in the rotation direction C. However, in the case where the winding is performed in such a manner that the recording surface 16 is on the inner side, by setting the winding unit 15 to a position that is horizontally mirror-inverted to the position illustrated in FIG. 1, it is possible to wind the medium P by rotating the rotation axis of the winding unit 15 in a direction opposite to the rotation direction C.

The platen 2 of the recording apparatus 1 is provided with a heater 6. The heater 6 is provided in order to heat up (so-called pre-heat) the medium P before recording is performed by a recording head 12 serving as the recording unit. Further, the recording apparatus 1 of the embodiment has a configuration in which the medium P is preheated from a surface 17 side, which is on the opposite side to the recording surface 16 of the medium P, by using the heater 6. However, for example, a configuration may be used in which the medium P is preheated from the recording surface 16 side by using a heater that is capable of heating the medium P by irradiating infrared rays from the recording surface 16 side.

The recording apparatus 1 is provided with a drive roller 5 that has a rotation shaft that extends in an intersecting direction B that intersects a transport direction A between the platen 2 and the platen 3 and that applies a feeding force to the surface 17 of the medium P. In addition, a driven roller 7 that has a rotation shaft that extends in the intersecting direction B is provided at a position that faces the drive roller 5. The medium P can be interposed between the drive roller 5 and the driven roller 7 that form a roller pair. By adopting such a configuration, a transport unit 9 is formed of the drive roller 5 and the driven roller 7. Here, a driven roller refers to a roller that rotates with the transportation of the medium P. In addition, when the target medium P is transported in the transport direction A, the drive roller 5 rotates in the rotation direction C and the driven roller 7 rotates in a direction opposite to the rotation direction C. Because a rotational force is applied as described above and the medium P is taken up and transported from the setting unit 14 to the winding unit 15 via the platens 2 to 4, the setting unit 14, the platens 2 to 4, and the winding unit 15 cooperate with the above-mentioned driving and driven rollers and transport the medium P while supporting the medium P facing the recording head 12.

In addition, the recording apparatus 1 includes the liquid ejecting apparatus 40 on the side facing the platen 3. The liquid ejecting apparatus 40 houses the recording head 12 in the carriage 11 which is a device casing. Therefore, the carriage 11 corresponds to the housing unit of this application. The recording head 12 ejects ink, which is an example of a liquid, from the nozzle forming surface F to the medium P in an ejection direction D (in a direction from the nozzle forming surface F to the medium P; in the embodiment, a vertically downward direction) to form an image. The recording head 12 has a so-called line head configuration that faces the medium P and in which a plurality of nozzles 12*a* are provided in an intersecting direction B intersecting with the transport direction A to form nozzle rows, and corresponds to the liquid ejecting unit of this application. Here, the term "line head" refers to a recording head in which a nozzle region formed in the intersecting direction B that intersects the transport direction A of the medium P is provided in such a manner as to be capable of covering substantially the entire region of the medium P in the intersecting direction B, and is used in a recording apparatus that forms an image by moving a recording head and the medium P relative to each other. In this embodiment, without moving the recording head 12 during ink ejection, the recording head 12 and the medium P are moved relative to each other by moving the medium P in the transport direction A; however, without moving the medium P during ink ejection from the recording head 12, the recording head 12 and the medium P may be moved relative to each other by ejecting ink while moving the recording head 12 from the downstream side to the upstream side in the transport direction A. In addition, the recording head 12 is not limited to a line head, but may be a serial head that performs printing in the recording area by moving the recording head in the transport direction A or the intersecting direction B a plurality of times. FIG. 2 illustrates the liquid ejecting apparatus 40 of the recording apparatus 1 in the case where the recording head 12 is a serial head and the recording head 12 is moved in the transport direction A and the plurality of the nozzles 12*a* are disposed in the intersecting direction B so as to form nozzle rows. The length of the region of the nozzle rows is, generally, formed to be shorter than the length of the medium P in the intersecting direction B, but it may be longer than the length of the medium P in the intersecting direction B. In addition, in the case where the recording head 12 is moved in the intersecting direction B, the plurality of nozzles 12*a* are disposed in the transport direction A and form nozzle rows. The length of the region of the nozzle rows is, generally, formed to be shorter than the length of the recording area of the medium P in the transport direction A, but it may be longer than the length of the recording area of the medium P in the transport direction A. In addition, the nozzle rows may be formed by arranging a plurality of the nozzles 12*a* in a line in a single head regardless of whether the recording head is a line head or a serial head, or as illustrated in FIG. 2, by arranging a plurality of single heads having nozzle rows so that the nozzle rows partially overlap when viewed from a direction intersecting with the arrangement direction of the nozzles, a single nozzle row may be formed in a pseudo manner. Further, in the case where the recording head 12 is a serial head, the recording head 12 is moved via the carriage 11, and such carriage driving is performed by a guide rail (not illustrated) and a driving motor (not illustrated) along the scanning direction.

The recording apparatus 1 includes a heater 8 on the downstream side of the recording head 12 in the transport direction A and irradiates the medium P with infrared light from the heater 8 to heat the medium P. The heater 8 is designed to dry the ink by irradiating the infrared light toward the region recorded on by the recording head 12. The heater 8 is provided at a position facing the platen 3 and is an infrared ray heater capable of heating the recording surface 16 side of the medium P; however, the heater 8 is not limited to such a heater and a heater capable of heating the medium P from the platen 3 side (the surface 17 side) may be used.

The recording apparatus 1 is provided with a heater 13 capable of irradiating infrared light on the most downstream side in the transport direction A of the medium P. The heater 13 is provided at a position facing the platen 4 and is an infrared ray heater capable of heating the recording surface 16 side of the medium P; however, the heater 13 is not limited to such a heater and a heater capable of heating the medium P from the platen 4 side (the surface 17 side) may be used. In addition, for example, instead of a heating device such as an infrared heater, a blowing device such as a fan can alternatively be used.

In addition, the liquid ejecting apparatus 40 includes a detection unit 100 on the upstream side of the recording head 12 in the transport direction of the medium P. In the case where the recording head 12 is a serial head and the recording head 12 moves in the transport direction A or in the case where the recording head 12 is a line head, a plurality (specifically four units) of detection units 100, as illustrated in FIG. 2, are mounted and fixed in the carriage 11 over the entire width direction (intersecting direction B) of the medium P having the maximum width that the recording apparatus 1 can deal with. In addition, in the case where the recording head 12 is a serial head and the recording head 12 moves in the transport direction A, the four of the detection units 100 may together have about the same width as the carriage 11 and even when the width of the carriage 11 is smaller than the maximum width, which the recording apparatus 1 can deal with, of the medium P in the width direction, because the four of the detection units move in the intersecting direction B together with the carriage 11 in accordance with the line feed operation of the recording head 12 for a plurality of moves, there is no problem with the detection of a foreign object, which will be described later, for the medium P having the maximum width that the recording apparatus 1 can deal with.

Figure 3:
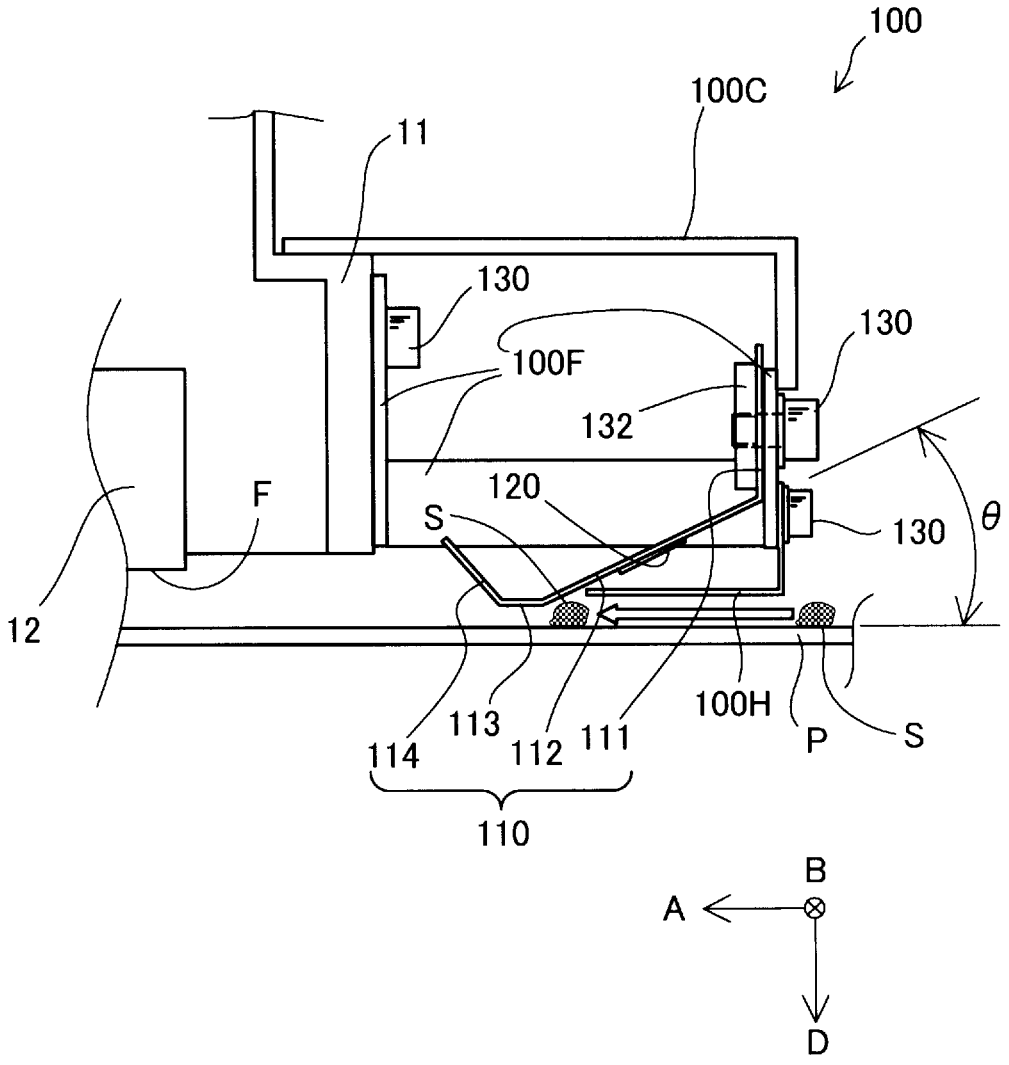
FIG. 3 is an explanatory view illustrating a configuration of a detection unit by sectioning a detection unit along line III-III of FIG. 2.
Figure 4:
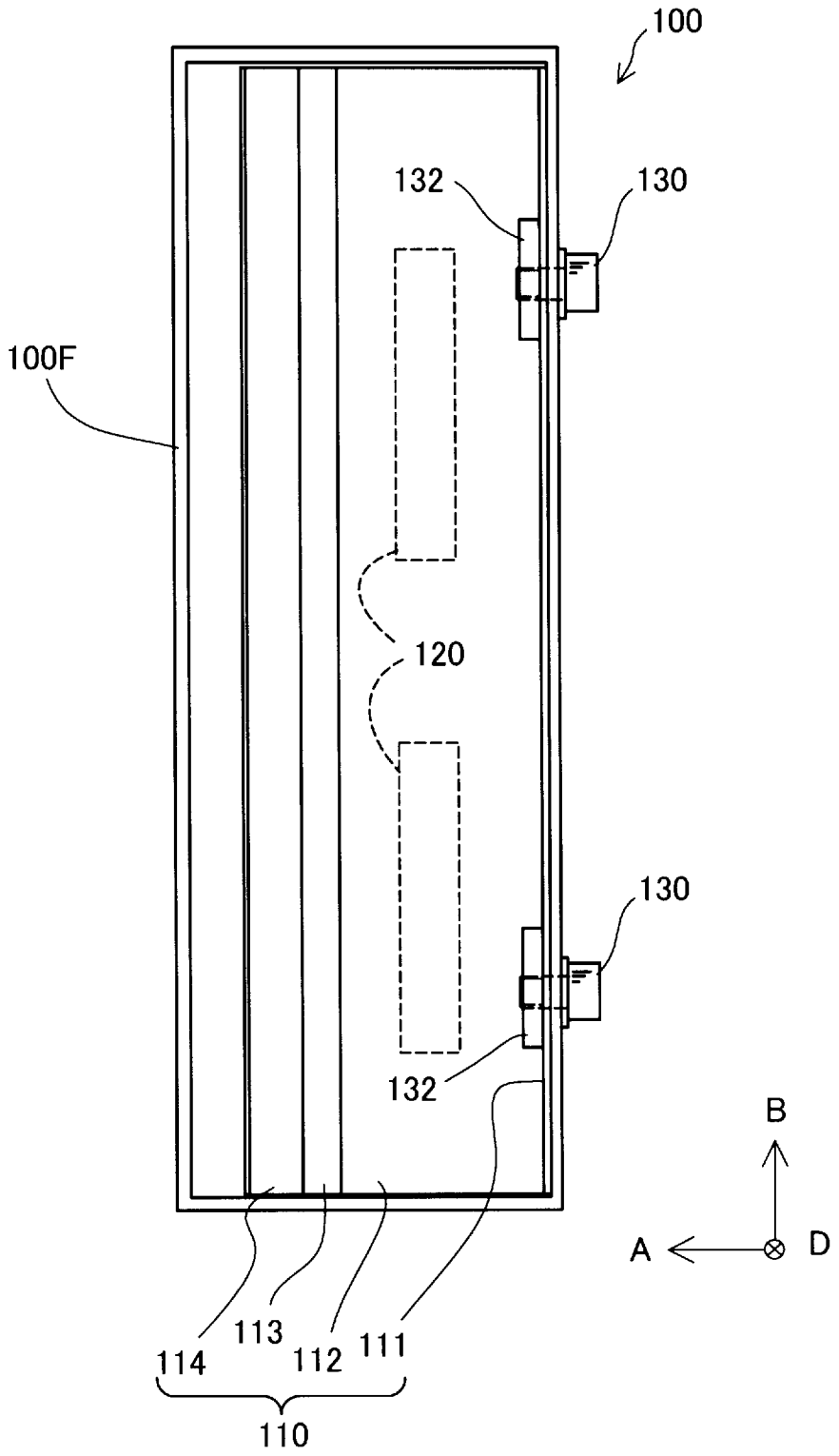
FIG. 4 is an explanatory view illustrating a configuration of the detection unit in a plan view of the detection unit in an ejection direction.
Figure 5:
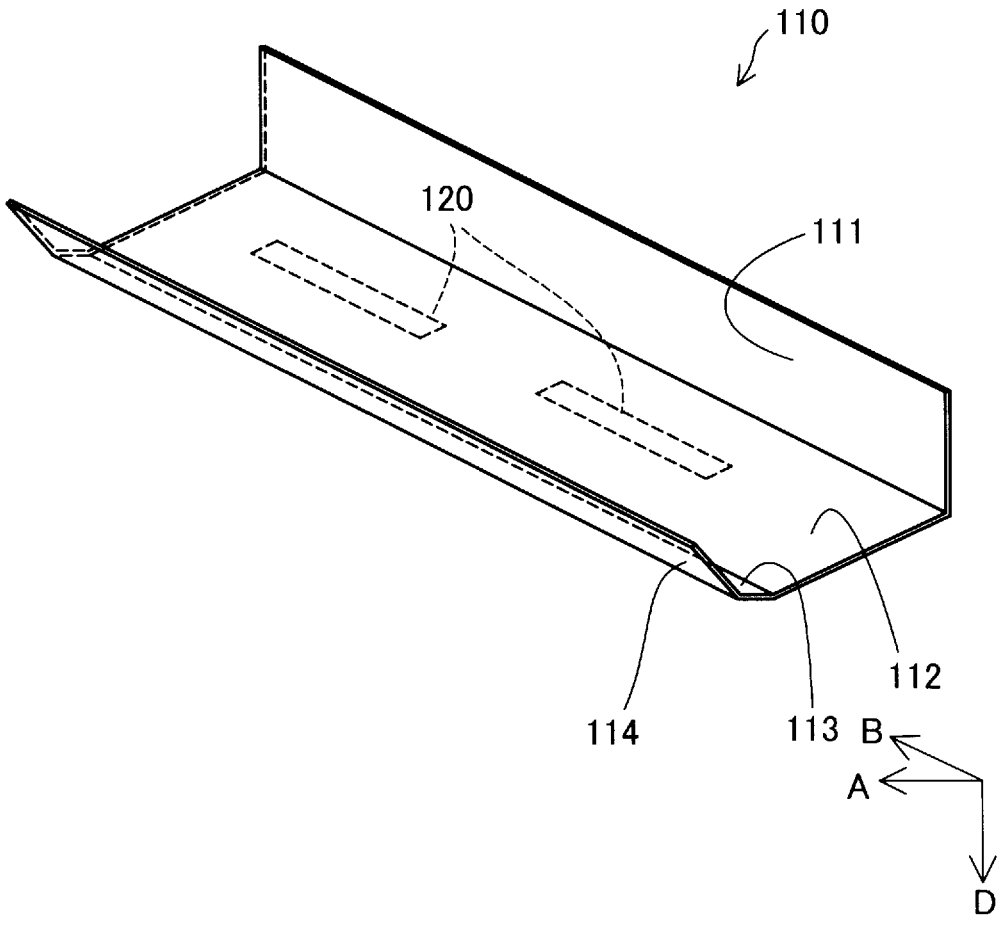
FIG. 5 is an explanatory view illustrating the outline of a foreign object detection plate included in the detection unit in a perspective view.

FIG. 3 is an explanatory view illustrating the configuration of the detection unit by sectioning the detection unit 100 along line III-III in FIG. 2. FIG. 4 is an explanatory view illustrating the configuration of the detection unit in plan view of the detection unit 100 in the ejection direction D. FIG. 5 is an explanatory view schematically illustrating a foreign object detection plate 110 included in the detection unit 100 in a perspective view. Further, in FIG. 3, in order to ensure visibility, hatching that indicates a member cross section has been omitted.

As illustrated in FIG. 4, the detection unit 100 includes the foreign object detection plate 110 surrounded by a frame 100F, and piezoelectric film sensors 120 are provided on the foreign object detection plate 110. As illustrated in FIG. 3, the frame 100F is fixed to the carriage 11 by bolts 130 and holds the foreign object detection plate 110 on the upstream side of the recording head 12 in the transport direction A while surrounding the foreign object detection plate 110. As a result, a first plate portion 111, which will be described later, of the foreign object detection plate 110 is fixed to the carriage 11 that houses the recording head 12.

In the detection unit 100, the foreign object detection plate 110 is protected from the upper surface side of the plate by fixing an upper cover 100C to the upper end of the frame 100F, and the foreign object detection plate 110 is protected from the lower surface side of the plate by fixing a lower cover 100H to the lower end of the frame 100F. By providing the upper cover 100C and the lower cover 100H for each detection unit and by arranging the four of the detection units 100 in a line, the foreign object detection plates 110 are protected from the upper surface side over the entire region in the intersecting direction B.

The foreign object detection plate 110 is a single plate material and corresponds to a detection unit that detects the presence of a foreign object that may come into contact with the nozzle forming surface F of the recording head 12 with movement of the recording head 12 or transportation of the medium P, wrinkles, folds, or tears formed on the medium P, or the medium P itself which has risen (hereinafter collectively referred to as a foreign object S). Detection of a foreign object will be described later.

The foreign object detection plate 110 for detecting a foreign object includes the first plate portion 111, a second plate portion 112, a third plate portion 113, and a fourth plate portion 114 that are continuous with one another. In this embodiment, in order to secure rigidity for shape maintenance and reliable strain induction upon detection of a foreign object (to be described later), the foreign object detection plate 110 is a plate material shaped and formed by subjecting a stainless steel plate of about 0.2 to 0.5 mm to press forming. The foreign object detection plate 110 may be formed of a plate material such as aluminum or titanium. In addition, engineering plastics such as polyamide, polycarbonate or the like which can secure rigidity and induce reliable strain may be used as the foreign object detection plate 110, or these plastics may be formed as an integral molded article or the like.

The first plate portion 111 is fixed to the frame 100F over the entire surface thereof with bolts 130 and nuts 132, and holds the second plate portion 112 and the third plate portion 113, which are continuous, in a cantilever shape. Here, note that the cantilever shape refers to a state in which the foreign object detection plate 110 is fixed to the frame 100F only at one end portion (the first plate portion 111 in FIG. 4) of the foreign object detection plate 110 in a direction intersecting the extending direction of the nozzle rows (the transport direction A in FIG. 4), and the other end portion of the foreign object detection plate 110 is not fixed but is a free end. In addition, the first plate portion 111 is fixed to the carriage 11 via the frame 100F at a position separated from the recording head 12 housed in the carriage 11.

In the second plate portion 112, the piezoelectric film sensors 120 are mounted on the surface of the plate on the medium P side. Further, the second plate portion 112 bends from the first plate portion 111 toward the recording head 12, is continuous therewith, and is disposed diagonally with respect to the vertical direction of the medium P. The formed angle θ (refer to FIG. 3) between the second plate portion 112 and the medium P is 25°. In this case, the angle θ between the second plate portion 112 and the medium P is not limited as long as it is 30° or less, and is determined depending on the size of the detection unit 100 along the transport direction A, the minimum size of the foreign object to be detected, required detection sensitivity and the like. The formed angle θ between the second plate portion 112 and the medium P will be described later.

The third plate portion 113 is bent and continuous from the second plate portion 112 and faces the medium P leaving a gap between the third plate portion 113 and the medium P. More specifically, the third plate portion 113 is a plate portion parallel to the medium P, and has a width of 3 mm along the transport direction A. The gap with the medium P is specified in accordance with the size of the smallest foreign object to be detected; in the embodiment, the foreign object detection plate 110 was fixed to the frame 100F at the first plate portion 111 in such a manner that the gap between the third plate portion 113 and the medium P was set to 0.5 to 2.0 mm. The fourth plate portion 114 is bent from and continuous with the third plate portion 113 and is bent toward a side away from the medium P.

As illustrated in FIG. 3, the piezoelectric film sensor 120 has a rectangular shape and is attached to the sensor mounting surface of the second plate portion 112, which faces the medium P, by using an adequate adhesive. As illustrated in FIGS. 4 and 5, the foreign object detection plate 110 has two of the piezoelectric film sensors 120 included in the second plate portion 112 along the intersecting direction B and each of the piezoelectric film sensors 120 is mounted on the second plate portion 112 so that the longitudinal direction thereof is along the intersecting direction B. The piezoelectric film sensors 120 output an electric signal corresponding to distortion occurring in the second plate portion 112 to a control unit 18 described later. The distortion of the second plate portion 112 occurs when a foreign object S (refer to FIG. 3) comes into contact with the foreign object detection plate 110, specifically the second plate portion 112 or the third plate portion 113, and consequently the piezoelectric film sensors 120 output an electric signal at the time of contact with the foreign object. Because the piezoelectric film sensors 120 have a sensor configuration in which piezoelectric elements are disposed in a film form, they detect a slight distortion of the second plate portion 112 as a displacement, and then output an electric signal corresponding to the slight distortion of the second plate portion 112.

Figure 6:
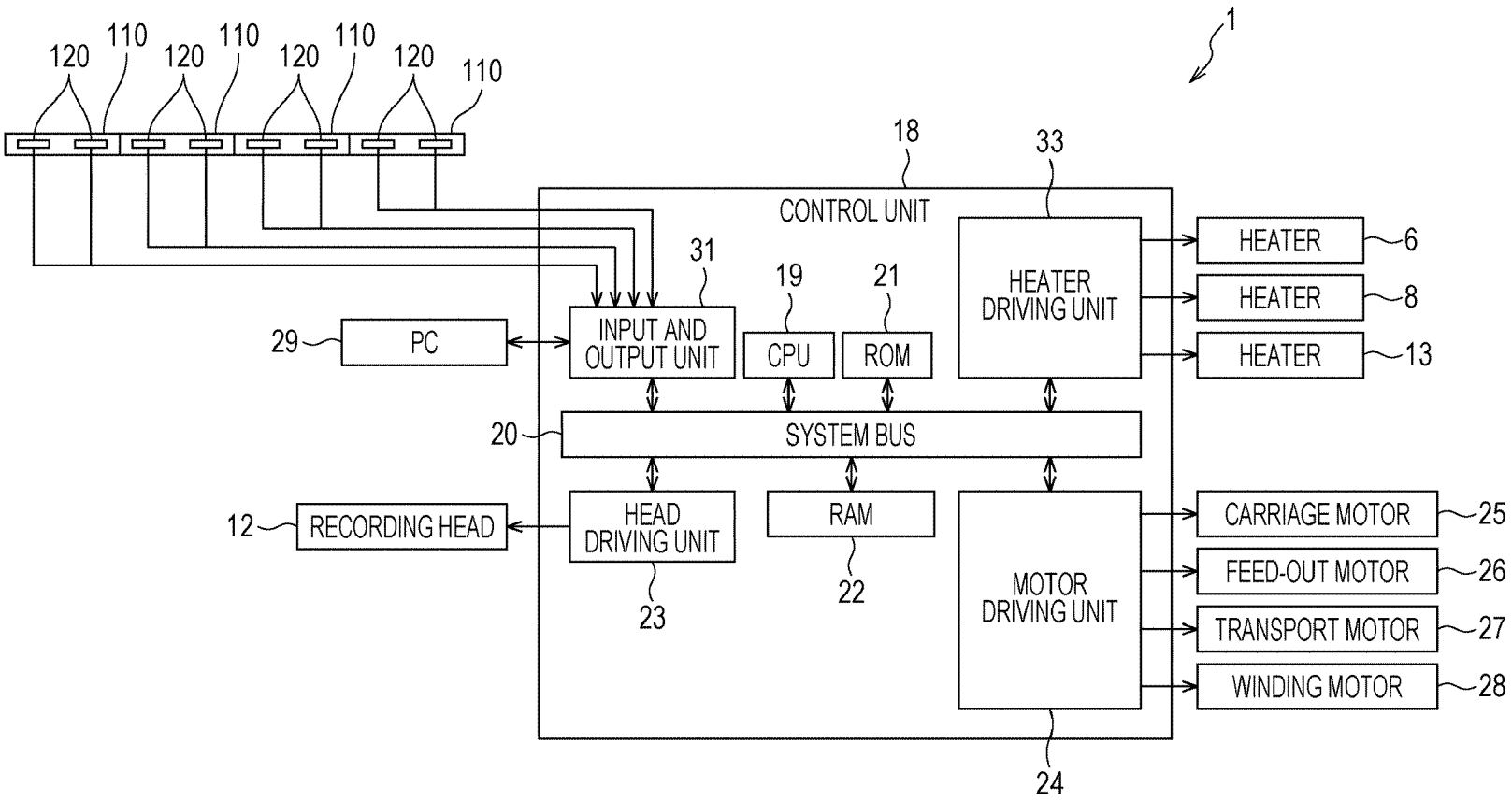
FIG. 6 is a block diagram illustrating an electrical configuration of a recording apparatus according to an embodiment.

Next, the electrical configuration of the recording apparatus 1 of the embodiment will be described. FIG. 6 is a block diagram illustrating an electrical configuration of the recording apparatus 1 according to the embodiment. A CPU 19 that is capable of controlling the entirety of the recording apparatus 1 is provided in the control unit 18. The CPU 19 is connected, via a system bus 20, to a ROM 21 that stores individual control programs and the like that the CPU 19 performs and a RAM 22 that is capable of temporarily storing data.

The CPU 19 is connected, via the system bus 20, to a head driving unit 23 that drives the recording head 12. In addition, the CPU 19 is connected via the system bus 20 to a motor driving unit 24 that drives a carriage motor 25, which moves the carriage 11, a feed-out motor 26, which is a drive source for the setting unit 14, a transport motor 27, which is a drive source for the drive roller 5, and a winding motor 28, which is a drive source for the winding unit 15. In addition, the CPU 19 is connected, via the system bus 20, to a heater driving unit 33 that drives the heater 6, and both the heater 8 and the heater 13. Furthermore, the CPU 19 is connected to an input and output unit 31 via the system bus 20, and the input and output unit 31 is connected to the two of the piezoelectric film sensors 120 for the foreign object detection plate 110 and a PC 29, which is an external device for inputting recording data and the like to the recording apparatus 1. Note that the PC 29 need not be an external device but may be one of the components of the recording apparatus 1.

In the case where the piezoelectric film sensors 120 output an electric signal associated with the distortion of the second plate portion 112, the liquid ejecting apparatus 40 according to this embodiment, under the control of the control unit 18, stops ejection of ink by the recording head 12 provided in the carriage 11 and stops relative movement between the medium P and the recording head 12. Further, in the case where the piezoelectric film sensors 120 output an electric signal associated with the distortion of the second plate portion 112, a message to the effect that a foreign object has been detected may be displayed on the display unit, or notification may be made by lighting a lamp, sounding a buzzer or the like.

The liquid ejecting apparatus 40 of this embodiment, which is described above, detects a foreign object on the surface of the medium in the following manner. As illustrated in FIG. 3, as the medium P is transported, the foreign object S on the surface of the medium P reaches the second plate portion 112 or the third plate portion 113 of the foreign object detection plate 110 and pushes up the second plate portion 112 or the third plate portion 113. As a result of this pushing up, the second plate portion 112 bends about the fixing portion of the first plate portion 111, specifically the vertical fixing portion on the frame 100F, whereby distortion occurs in the second plate portion 112. Then, the piezoelectric film sensors 120, which are attached to the second plate portion 112, output an electric signal corresponding to the distortion of the second plate portion 112 to the control unit 18 even if the distortion is small. Then, the control unit 18 receives the electric signal from the piezoelectric film sensors 120 thereby detecting the foreign object S and stops at least one of the ink ejection by the recording head 12 and the transportation of the medium P by the transport unit 9 (refer to FIG. 1). As a result, in the liquid ejecting apparatus 40 of this embodiment product, even without using an optical detection device, it is possible to detect a foreign object S on the medium P with the same degree of accuracy as an optical detection device. In addition, at the time of detection of the foreign object S on the medium P by the piezoelectric film sensors 120, which are mounted on the second plate portion 112, the foreign object S has not yet reached the recording head 12 (refer to FIG. 3). Therefore, in the liquid ejecting apparatus 40 of this embodiment product, it is possible to suppress damage to the medium P or the recording head 12 caused by contact between the foreign object S and the recording head 12 with a high degree of certainty. In addition, detection of a foreign object S is made based on whether or not the value of the electric signal from the piezoelectric film sensors 120 exceeds a preset threshold value. Therefore, by adjusting the threshold value, the sensitivity of detection of a foreign object S can be adjusted.

In the liquid ejecting apparatus 40 according to this embodiment, the first plate portion 111 is fixed to the carriage 11 containing the recording head 12 via the frame 100F. Therefore, for detection of a foreign object S on the medium P, the foreign object detection plate 110 with the piezoelectric film sensors 120 mounted thereon need only be fixed to the carriage 11 via the first plate portion 111 and the frame 100F eliminating the need for specific apparatus adjustment and electrical control equipment. As a result, according to the liquid ejecting apparatus 40 of this embodiment product, it is possible to simplify the adjustment of the mechanical device while improving the precision of detection of a foreign object S.

In the liquid ejecting apparatus 40 of this embodiment, the first plate portion 111 is fixed apart from the recording head 12 on the upstream side in the transport direction A, and the second plate portion 112, as illustrated in FIG. 3, is continuous from the first plate portion 111 toward the recording head 12. In this way, because the third plate portion 113 bent from the second plate portion 112 is positioned on the side of the recording head 12, the size of the apparatus along the transport direction A of the medium P can be reduced.

In the liquid ejecting apparatus 40 according to this embodiment, the entire area of the foreign object detection plate 110 is covered with the upper cover 100C. Therefore, in the liquid ejecting apparatus 40 of this embodiment product, accidental damage of the foreign object detection plate 110 can be avoided even if a foreign object such as a pen or an ink cartridge drops onto the foreign object detection plate 110 from above the foreign object detection plate 110. In addition, the liquid ejecting apparatus 40 of this embodiment product covers the second plate portion 112 with the lower cover 100H on the side of the medium P further upstream than the second plate portion 112 in the transport direction A. Therefore, in the liquid ejecting apparatus 40 of this embodiment, even in the case where the foreign object S of the medium P approaches the foreign object detection plate 110, specifically the second plate portion 112, as the medium P is transported, it is possible to avoid inadvertent damage to the second plate portion 112.

Figure 7:
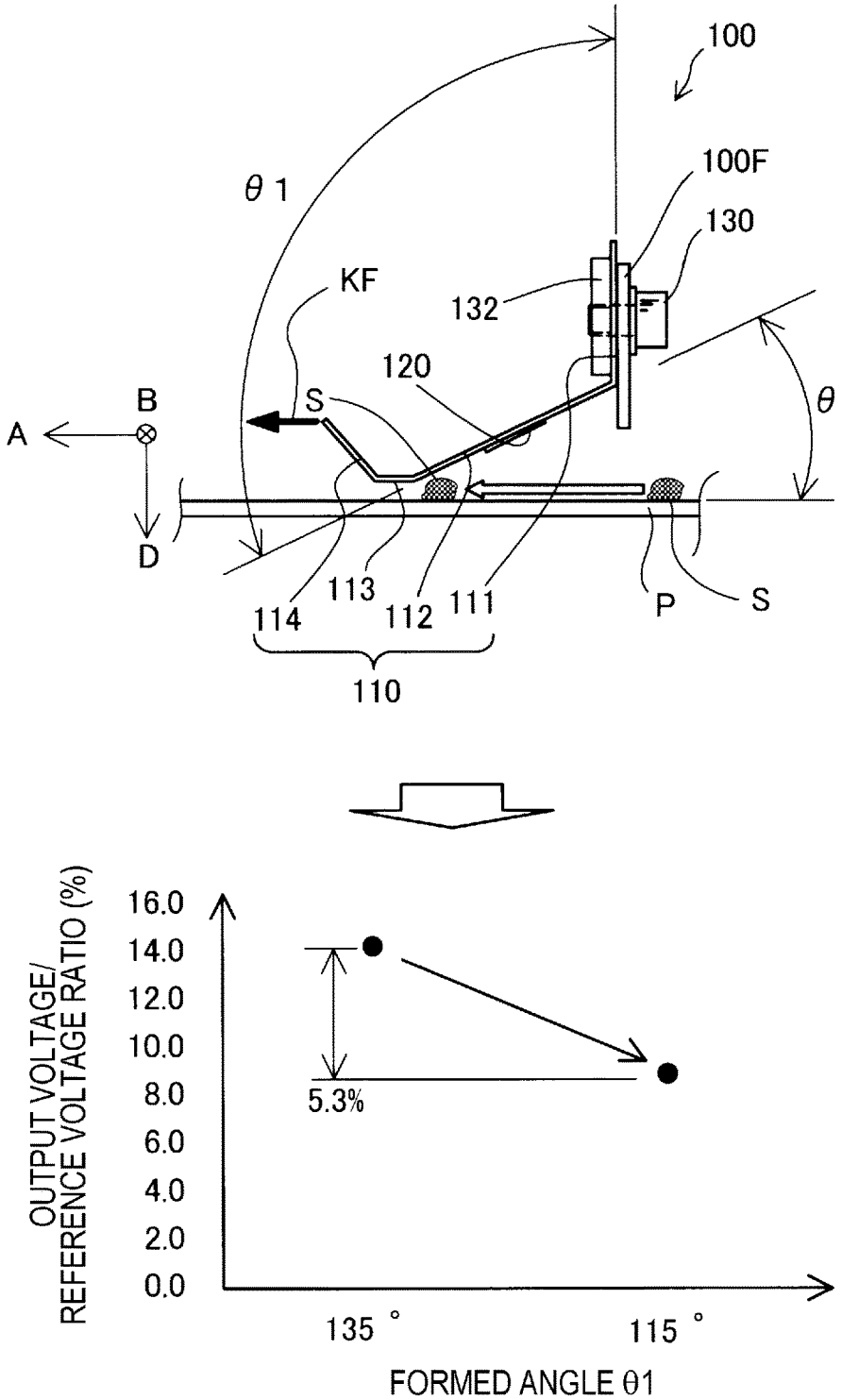
FIG. 7 is an explanatory view schematically explaining an effect obtained by defining a formed angle between a second plate portion of a foreign object detection plate and a medium.

In the liquid ejecting apparatus 40 of this embodiment, the second plate portion 112 is made to continue from the first plate portion 111 in such a manner that the formed angle θ (refer to FIG. 3) between the second plate portion 112 and the medium P is 25°. By doing this, there are the following advantages. FIG. 7 is an explanatory view schematically explaining an effect obtained by defining a formed angle θ between the second plate portion 112 of the foreign object detection plate 110 and the medium P. Further, in FIG. 7, only members necessary for foreign object detection are illustrated.

Because the foreign object detection plate 110 of the detection unit 100 is fixed to the frame 100F by the first plate portion 111 and the third plate portion 113 is cantilevered with the second plate portion 112 interposed therebetween, in the case where the carriage 11 is moved in the transport direction A, the third plate portion 113 vibrates in the vertical direction about the fixing portion of the first plate portion 111. Such vibration leads to a decrease in the detection accuracy of the piezoelectric film sensor 120. In addition, such vibration is affected by the formed angle θ1 between the first plate portion 111, which is fixed, and the second plate portion 112 that is continuous therewith. When the formed angle θ1 is 90°, it is considered that the influence of the vibration is the smallest; however, if the formed angle θ1 is set to 90°, because the second plate portion 112 becomes parallel to the medium P and the risk of the foreign object S directly coming into contact with the piezoelectric film sensor 120 and destroying the piezoelectric film sensor 120 increases, it is preferable that the formed angle θ1 be greater than 90°. In addition, for specifying the formed angle θ1, the following experiment was conducted. In this experiment, first, the formed angle θ illustrated in FIG. 7 is set at various angles, specifically, various of the foreign object detection plates 110 of 45° and 25° (this embodiment) were prepared and each of the foreign object detection plates 110 was fixed to the frame 100F. In the case where these foreign object detection plates 110 are fixed, the formed angles θ1 between the first plate portion 111 and the second plate portion 112 illustrated in FIG. 7 are 135° and 115°, respectively. Further, each of the foreign object detection plates 110 used in this experiment was a stainless steel plate material, and the plate thickness was 0.2 mm.

Next, in the liquid ejecting apparatus 40 having the foreign object detection plates 110 mounted therein, the power source of the recording apparatus 1 was turned on, and the voltage value output from the piezoelectric film sensor 120 was measured in a state where the carriage 11 and the medium P were not moving, and this voltage value was used as a reference voltage. With respect to the foreign object detection plates 110 in which the formed angles θ1 were 135° and 115°, respectively, detection output voltages obtained from the piezoelectric film sensors 120 were obtained when the carriage 11 was moved in the transport direction A under the condition that no foreign object was present and the detected output voltages were each divided by the reference voltage to obtain an output voltage/reference voltage ratio (%). In the lower portion of FIG. 7, the output voltage/reference voltage ratio in the case where the formed angle θ1 and the formed angle θ illustrated in the upper portion of FIG. 7 are respectively 135° and 45°, and the output voltage/reference voltage ratio in the case where the formed angle θ1 and the formed angle θ illustrated in FIG. 7 are respectively 115° and 25° (this embodiment) are illustrated. Further, in the case where the formed angle θ1 was 135°, the influence of the vibration of the carriage 11 was marked and the detection unit 100 was not able not achieve sufficient reliability to withstand actual use, and in the case where the formed angle θ1 was 115°, the influence of the vibration of the carriage 11 was small, and the detection unit 100 was able to achieve sufficient reliability to withstand actual use.

In the liquid ejecting apparatus 40 of this embodiment, because the formed angle θ between the second plate portion 112 and the medium P is set to 25°, the second plate portion 112 forms an angle of 115° with respect to the vertical line at the fixed portion of the first plate portion 111. With such a bending angle, as can be seen from the lower graph of FIG. 7, compared with the case where the formed angle θ1 (bending angle) between the second plate portion 112 and the vertical line at the fixing portion of the first plate portion 111 was 135° , it was found that the output voltage/reference voltage ratio was improved by 5.3%. The improvement of the output voltage/reference voltage ratio is caused by the suppression of the vibration of the second plate portion 112 due to a decrease in the influence of the moment of inertia acting on the second plate portion 112. That is, this illustrates that the S/N ratio improves more than in the case where the formed angle is 135° as a result of a decrease in noise caused by vibration when the formed angle θ1 is 115°. From these experimental results, in the liquid ejecting apparatus 40 of this embodiment, it can be said that the S/N ratio of the foreign object S can be further increased by suppressing the vibration of the second plate portion 112. In addition, in the case where the threshold value of the output voltage of the piezoelectric film sensor 120 that detects a foreign object S is set to 16.5% of the reference voltage, by setting the safety ratio to 1.5, it is preferable that the output voltage of the piezoelectric film sensor 120 when the carriage 11 is moved in the transport direction A under the condition that no foreign object is present result in an output voltage/reference voltage ratio of 11% or less and, from the graph in the lower portion of FIG. 7, it is preferable that the formed angle θ1 be set to about 120° or less. At this time, it is preferable to set the formed angle θ to 30° or less. By setting the formed angles θ and θ1 as described above, the influence of the vibration of the carriage 11 on the detection of the foreign object S can be reduced.

As illustrated in FIG. 3, in the liquid ejecting apparatus 40 of this embodiment, the fourth plate portion 114 was bent from the third plate portion 113 and toward a side away from the medium P. Therefore, according to the liquid ejecting apparatus 40 of this embodiment product, even when the medium P rises at the position of the detection units 100 when the medium P is transported in a direction opposite to the transport direction A illustrated in FIG. 3, because the medium P being reversely transported is pushed down by the fourth plate portion 114, transport jam of the medium being reversely transported can be suppressed by the fourth plate portion 114. Further, the foreign object detection plate 110 illustrated in FIG. 3 may be formed in a shape which is line symmetrically inverted with respect to the vertical line. That is, the second plate portion 112 may be continuous with and bent from the first plate portion 111 toward the upstream side of the recording head 12 in the transport direction A. In this case, a foreign object S can be guided to the third plate portion 113 by the fourth plate portion 114. In addition, in this case, the attachment position of the first plate portion 111 is not limited to the frame portion on the upstream side of the frame 100F in the transport direction A illustrated in FIG. 3 and may be attached to the frame portion on the downstream side of the frame 100F in the transport direction A opposite to the frame portion on the upstream side of the frame 100F in the transport direction A.

In the liquid ejecting apparatus 40 of this embodiment product, the third plate portion 113 is bent from the second plate portion 112 so as to be parallel with the medium P being transported. Therefore, in the liquid ejecting apparatus 40 of this embodiment product, in the case where the recording head 12 housed in the carriage 11 moves relative to the medium P in the transport direction A, the possibility of damage to the medium P caused by contact of the third plate portion 113 with the medium P can be suppressed compared with the case where the third plate portion 113 is bent from the second plate portion 112 in an acute angle shape protruding downward. Further, if the medium P has a high strength, there is no problem even if the third plate portion 113 is bent from the second plate portion 112 in a downwardly convex acute angle.

In the liquid ejecting apparatus 40 according to this embodiment, four of the detection units 100 are mounted and fixed on the carriage 11, and detection of a foreign object on the medium P having the maximum width that the recording apparatus 1 can deal with is possible as illustrated in FIG. 7. Each of the four detection units 100 is merely fastened to the carriage 11 via the frame 100F by bolt tightening. Therefore, in the liquid ejecting apparatus 40 of this embodiment product, if any malfunction of foreign object detection occurs in any of the detection units 100, it is possible to easily replace the detection unit 100 that is malfunctioning, and the malfunction can be recovered from easily and promptly. In addition to this, in the liquid ejecting apparatus 40 of this embodiment, the foreign object detection plate 110 is fixed to the frame 100F by merely tightening the bolts in each of the four of the detection units 100. Therefore, by simply removing the upper cover 100C of the detection unit 100 which has malfunctioned and replacing the foreign object detection plate 110 of the detection unit 100 which has malfunctioned, easy and quick recovery from the malfunction is possible.

The liquid ejecting apparatus 40 of this embodiment includes four of the detection units 100 facing divided regions obtained by dividing the medium P as a target of foreign object detection along the width direction thereof. Therefore, it has the following advantages. For example, if a foreign object S exists on the right end side in the width direction (intersecting direction B) of the medium P illustrated in FIG. 2, the rightmost one of the detection units 100 in FIG. 2 facing the divided region on the right end in the width direction emits an electric signal from the piezoelectric film sensors 120 which is larger than that of the detection unit 100 corresponding to the other divided region. The same is true when the foreign object S exists on the left end side in the width direction of the medium P illustrated in FIG. 2 or when the foreign object S exists on the right side of the width direction center or on the left side of the width direction center. Therefore, according to the liquid ejecting apparatus 40 of this embodiment product, by comparing the magnitudes of the electric signals output from the four of the detection units 100, it is possible to determine at which position in the width direction of the medium P a foreign object S exists.

In each of the four units of the detection units 100, the liquid ejecting apparatus 40 of this embodiment includes two piezoelectric film sensors 120 on the second plate portion 112 along the intersecting direction B (refer to FIGS. 4 and 5). Therefore, the detection accuracy of foreign object is enhanced.

The invention is not limited to the above-described embodiments and modification examples, and can be realized in various configurations without departing from the gist thereof. Technical features in the embodiment corresponding to technical features in each aspect described in the summary of the invention, other embodiments, and modification examples may be used to solve some or all of the above-mentioned problems and may be replaced or combined as appropriate in order to achieve some or all of the effects of the invention. In addition, unless technical features are described as essential in this specification, they can be deleted as appropriate.

In the above-described embodiment, the foreign object detection plate 110 is fixed to the carriage 11 via the frame 100F; however, the frame 100F may be provided on the upstream side of the recording head 12 in the transport direction separately from the carriage 11, and the foreign object detection plate 110 may be fixed to the frame 100F. That is, the foreign object detection plate 110 may be provided independently of the carriage 11. Besides this, the foreign object detection plate 110 may be fixed by housing the frame 100F itself in the carriage 11, or by forming the frame 100F with the frame body of the carriage 11.

In the embodiment described above, the first plate portion 111 is made to be separate from the recording head 12 and the second plate portion 112 is made to continue toward the recording head 12; however, the second plate portion 112 may be continued toward the first plate portion 111 on the side away from the recording head 12, that is, toward the upstream side in the transport direction.

In the embodiment described above, the formed angle θ between the second plate portion 112 and the medium P is set to 25°; however, as mentioned above, the formed angle θ between the second plate portion 112 and the medium P may be 30° or less, and the formed angle θ1 between the second plate portion 112 and the first plate portion 111, which is vertically fixed, may be more than 90° and not more than 120°.

Figure 8:
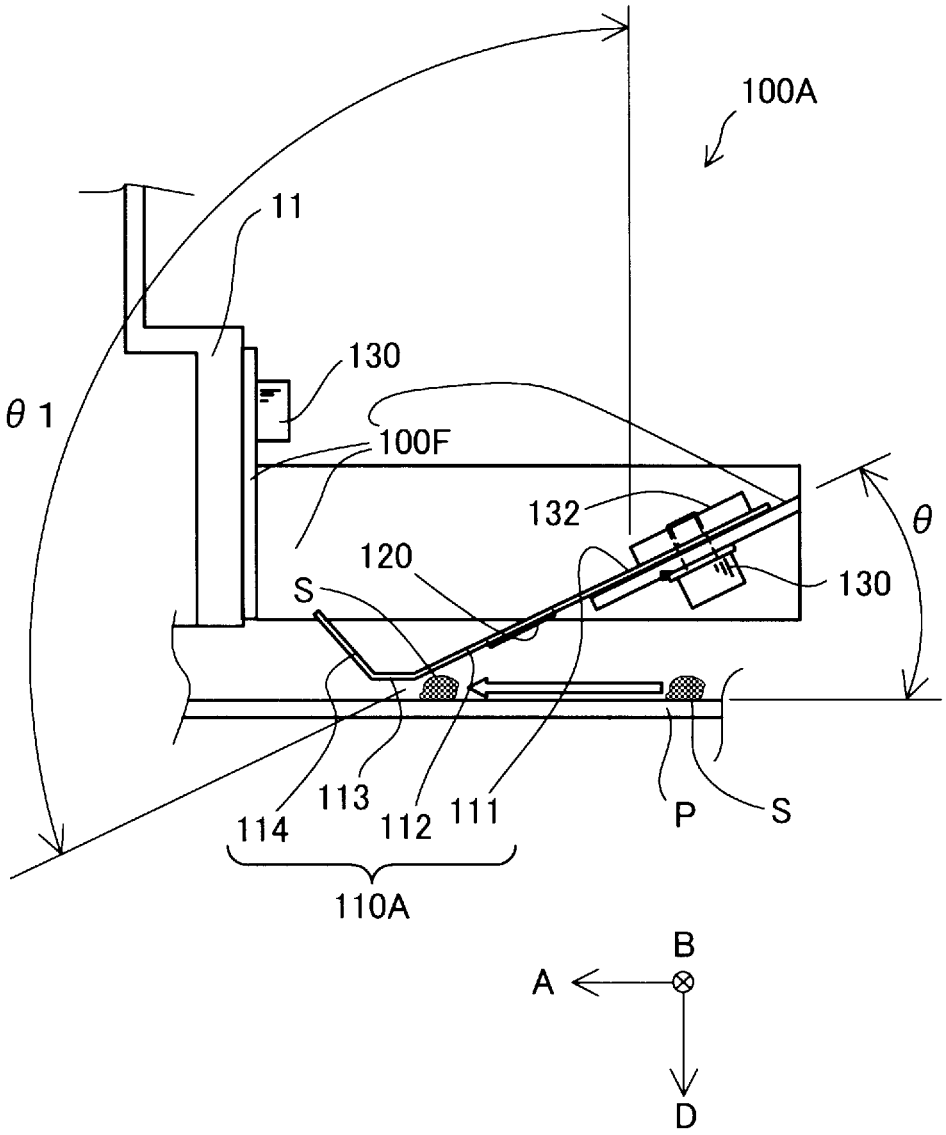
FIG. 8 is an explanatory view illustrating a main portion of a detection unit configuration by sectioning a detection unit having a foreign object detection plate according to a modification example.

In the embodiment described above, the second plate portion 112 is bent from the first plate portion 111, which is vertically fixed, so as to be continuous with the first plate portion 111, but it is not limited thereto. FIG. 8 is an explanatory view illustrating the main portion of the detection unit configuration by sectioning a detection unit 100A having a foreign object detection plate 110A according to a modification example. The detection unit 100A of this modification example includes the second plate portion 112 that continues linearly from the first plate portion 111 and is designed so that the formed angle θ between the fixing surface of the frame 100F, which is the fixing portion of the first plate portion 111, and the medium P is 30° or less (for example, 25°). Even in this case, the formed angle θ between the second plate portion 112 and the medium P is 30° or less, and the formed angle θ1 between the vertical line at the fixing portion of the first plate portion 111 and the second plate portion 112 exceeds 90° and is 120° or less.

In the above-described embodiment, the fourth plate portion 114 is bent from the third plate portion 113 toward the side away from the medium P; however, the fourth plate portion 114 may be omitted or the cross section of the free end of the third plate portion 113 may be arcuate.

Figure 9:
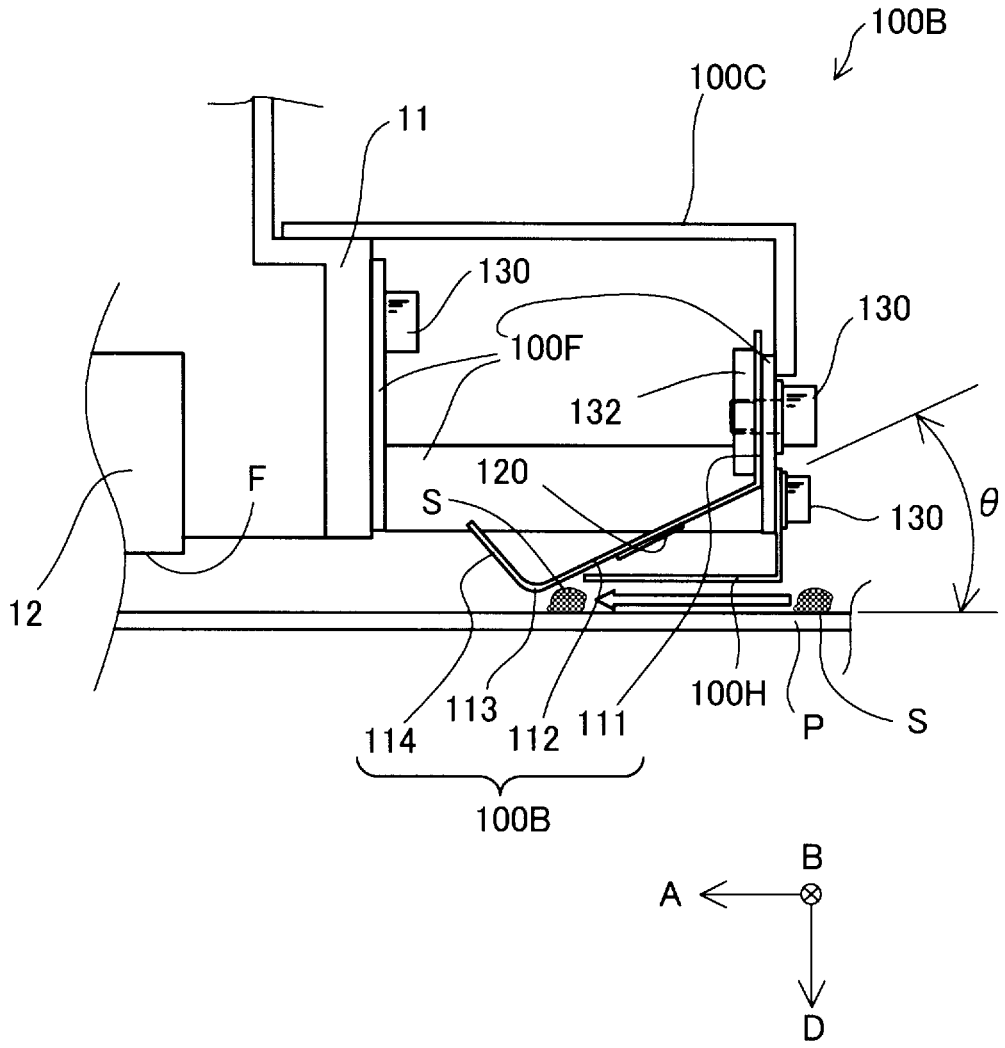
FIG. 9 is an explanatory view illustrating a main portion of a detection unit configuration by sectioning a detection unit having a foreign object detection plate according to a modification example.

In the above-described embodiment, the third plate portion 113 is parallel to the medium P, however, it is not limited thereto. FIG. 9 is an explanatory view illustrating the main portion of the detection unit configuration by sectioning a detection unit 100B having a foreign object detection plate 110B according to a modification example. In the detection unit 100B of this modification example, the third plate portion 113 which is continuous with the second plate portion 112 in the foreign object detection plate 110 is curved toward the medium P side.

In the above-described embodiment, as illustrated in FIG. 4, the third plate portion 113 extends in the width direction of the medium P along the intersecting direction B; however, the third plate portion 113 may extend diagonally to the intersecting direction B and in the width direction of the medium P.

In the above-described embodiment, the piezoelectric film sensors 120 are mounted on the sensor mounting surface (refer to FIG. 3) of the second plate portion 112 facing the medium P; however, the piezoelectric film sensors 120 may be mounted on the plate surface on the back side of the sensor mounting surface illustrated in FIG. 3.

This application claims priority under 35 U.S.C. § 119 to Japanese Patent Application No. 2017-019297, filed Feb. 6, 2017. The entire disclosure of Japanese Patent Application No. 2017-019297 is hereby incorporated herein by reference.

What is claimed is:

1. A liquid ejecting apparatus comprising:

a liquid ejecting unit that is arranged so as to face a medium and that ejects a liquid onto the medium;

a detection unit that detects the presence of an object that can come into contact with the liquid ejecting unit with relative movement between the medium and the liquid ejection unit; and a piezoelectric film sensor that is provided in the detection unit and that outputs an electric signal when the object comes into contact with the detection unit, wherein the detection unit has first, second, and third plate portions formed so as to be continuous, the first plate portion is fixed in such a manner that the second and third plate portions are cantilevered, the second plate portion, in a state where the piezoelectric film sensor has been mounted thereon, is continuous with the first plate portion and is disposed diagonally with respect to a vertical direction of the medium, and the third plate portion is bent from the second plate portion and faces the medium leaving a gap between the third plate portion and the medium.

2. The liquid ejecting apparatus according to claim 1, wherein the first plate portion is fixed to a housing unit that houses the liquid ejecting unit.

3. The liquid ejecting apparatus according to claim 1, wherein the first plate portion is fixed at a position separated from the liquid ejecting unit, and the second plate portion continues from the first plate portion toward a liquid ejecting unit side.

4. The liquid ejecting apparatus according to claim 1, wherein the second plate portion continues from the first plate portion so that a formed angle between the second plate portion and the medium is 30° or less.

5. The liquid ejecting apparatus according to claim 1, wherein the detection unit further includes a fourth plate portion bent from the third plate portion toward a side away from the medium.

* * * * *